United States Patent [19]

Sakamaki et al.

[11] 4,050,855

[45] Sept. 27, 1977

[54] DRY AIR ROTARY PUMP OR COMPRESSOR

[75] Inventors: Hiroshi Sakamaki, Utsunomiya; Toshiyuki Maeda, Ageo, both of Japan

[73] Assignees: Nippon Piston Ring Kabushiki Kaisha; Toyota Jidosha Kogyo Kabushiki Kaisha, Toyota, both of Japan

[21] Appl. No.: 653,953

[22] Filed: Jan. 30, 1976

[30] Foreign Application Priority Data

Feb. 26, 1975 Japan ..... 50-23583
Feb. 26, 1975 Japan ..... 50-26136[U]

[51] Int. Cl.[2] ..... F04C 15/00

[52] U.S. Cl. ..... 418/131; 252/12; 418/152; 418/153; 418/179

[58] Field of Search ..... 418/152, 153, 131, 132, 418/178, 179; 252/12

[56] References Cited

U.S. PATENT DOCUMENTS

| | | | |
|---|---|---|---|
| 2,662,483 | 12/1953 | Smith et al. | 418/152 |
| 2,665,056 | 1/1954 | Orban | 418/152 |
| 2,833,465 | 5/1958 | Cable | 418/152 |
| 3,050,009 | 8/1962 | Lowry | 418/153 |
| 3,187,993 | 6/1965 | Rhodes | 418/131 |
| 3,191,852 | 6/1965 | Kaatz et al. | 418/152 |
| 3,193,190 | 7/1965 | Lindberg | 418/152 |
| 3,233,524 | 2/1966 | Charlson | 418/152 |
| 3,282,222 | 11/1966 | Raufeisen et al. | 418/152 |
| 3,433,166 | 3/1969 | Birkmeier | 418/152 |
| 3,776,845 | 12/1973 | Watanabe et al. | 252/12 |
| 3,808,130 | 4/1974 | Schifer et al. | 252/12 |

FOREIGN PATENT DOCUMENTS

| | | | |
|---|---|---|---|
| 2,137,494 | 7/1971 | Germany | 418/178 |
| 2,054,033 | 5/1972 | Germany | 418/131 |
| 46-3736 | 8/1966 | Japan | 252/12 |

*Primary Examiner*—C. J. Husar
*Attorney, Agent, or Firm*—Stevens, Davis, Miller & Mosher

[57] ABSTRACT

A dry air rotary pump or compressor comprises a pair of flexible diaphragm type sealing plates which are clamped on the opposite ends of a stator housing by end heads to form a cylindrical pump cavity and to be pressedly contacted with the opposite end faces of a rotor driven within the pump cavity so as to provide the sealing between the suction and compression chambers of the pump or compressor. Each of the sealing plates is made of a composite consisting essentially, by weight, of 10.0 - 75.0% carbon and/or graphite, 0.1 - 60.0% molybdenum disulfide, 1.0 - 20.0% fluorine resin and the remainder, which is greater than 25.0% of the total composition by weight, being heat resistant synthetic resin without fluorine resin to have a coefficient of elasticity greater than 200 Kg/cm$^2$.

6 Claims, 2 Drawing Figures

DRY AIR ROTARY PUMP OR COMPRESSOR

BACKGROUND OF THE INVENTION

The present invention relates to rotary pumps or compressors, and more particularly to dry air rotary pumps or compressors suitable for use as a vacuum pump, wherein a rotor is eccentrically mounted within a stator housing and co-operates with the inner peripheral wall of the stator housing and with suitable end wall structure to form suction and compression or delivery chambers so as to generate compressed air or vacuum.

One of the inventors previously introduced a dry air rotary pump or compressor of the type in which a pair of flexible diaphragm type sealing plates are hermetically clamped on the opposite ends of a stator housing by end wall structures to be pressedly contacted with the opposite end faces of a rotor driven within the pump cavity so as to provide the sealing between the suction and compression or delivery chambers of the pump. In use of the rotary pump or compressor, it is necessary to ensure the volumetric efficiency of the pump that the flexible sealing plates are constantly pressed without any lubricating medium against the opposite end faces of the rotor due to the difference between internal pressure generated within the pump cavity and external pressure applied to the outside faces of the sealing plates.

One of the problems experienced in development of the pump or compressor is that the sealing plates are inevitably defaced by friction with the rotor to reduce the volumetric efficiency of the pump or compressor. Another problem is that the end-face sealing contacts of the sealing plates against the opposite end faces of the rotor are greatly influenced by flexibility and elasticity of the sealing plates.

SUMMARY OF THE INVENTION

It is therefore an object of the present invention to provide an improved sealing plate for the above-mentioned pump or compressor, which has suitable self-lubricating and anti-friction characteristics to assure the durability of the pump.

It is another object of the present invention to provide an improved sealing plate for the above-mentioned pump or compressor, which has good flexibility and elasticity to effectively maintain the end-face sealing contact against the end face of the rotor.

The inventors have discovered, after much experimentation, that excellent results are obtained with a sealing plate made of a composite consisting essentially, by weight, of 10.0 - 75.0% carbon and/or graphite, 0.1 - 60.0% molybdenum disulfide, 1.0 - 20.0% fluorine resin and the remainder, which is greater than 25.0% of the total composition by weight, being heat resistant synthetic resin without fluorine resin to have a coefficient of elasticity greater than 200 $Kg/cm^2$.

The inventors have further discovered that in order to give the sealing plate the most suitable flexibility and elasticity, the thickness of the sealing plate should be designed to satisfy the following equation;

$$\frac{\text{Thickness of the sealing plate}}{\text{Inner diameter of the stator}} = 0.001 \text{ to } 0.07$$

BRIEF DESCRIPTION OF THE DRAWINGS

Additional objects and advantages of the present invention will be more readily apparent from the following detailed description of a preferred embodiment thereof when taken together with the accompanying drawings in which.

DESCRIPTION OF THE PREFERRED EMBODIMENT

Figure 2:
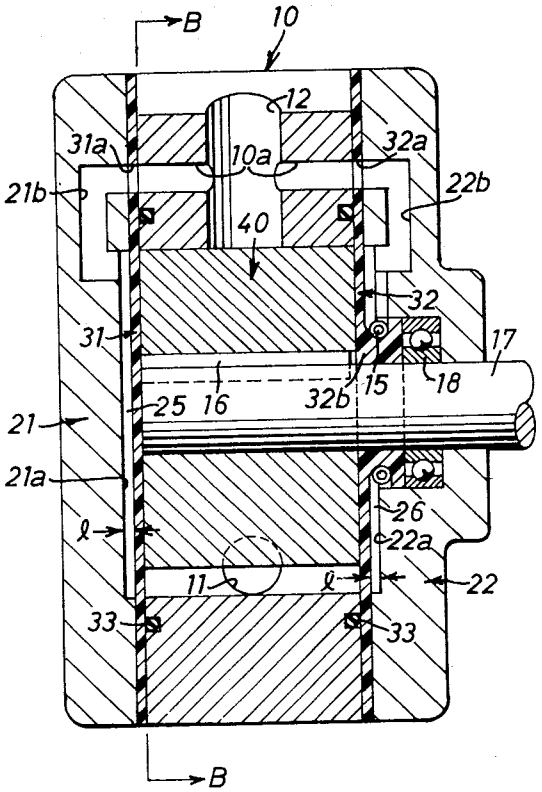
FIG. 2 is a sectional view substantially taken along the line A — A of FIG. 1.
Figure 1:
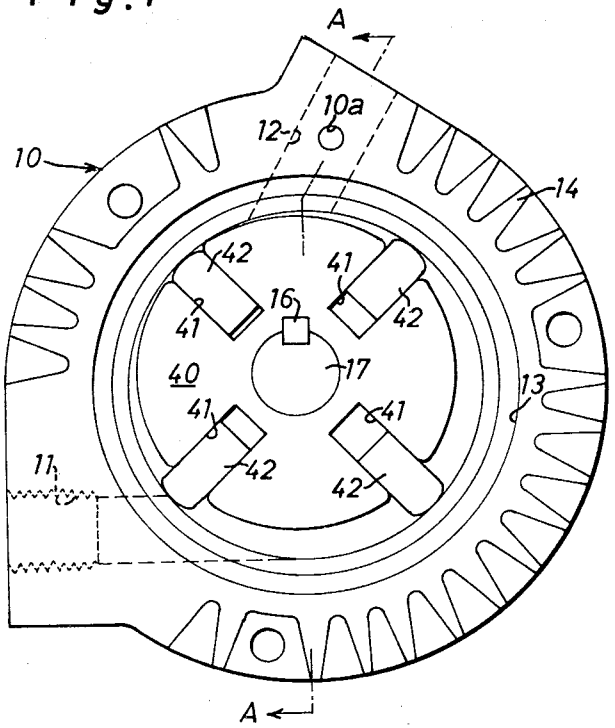
FIG. 1 is a sectional view of a preferred embodiment of the present invention taken along the line B — B of FIG. 2.

Referring now to the drawings, particularly in FIGS. 1 and 2, a dry air rotary pump comprises a stator housing 10 having an inlet or low pressure port 11 and an outlet or high pressure port 12 and a pair of end heads 21 and 22 hermetically secured to the opposite ends of the stator housing 10 by way of O-rings 33 and diaphragm type flexible sealing plates 31 and 32. The stator housing 10 is provided at each end face thereof with an annular groove 13 to receive the O-ring 33 therein and further provided with bypass passages **10*a* opening to the outlet port 12. On the outer periphery of the stator housing 10, a number of cooling fins 14 are provided to facilitate the dissipation of heat. On the opposite end faces of the stator housing 10, the diaphragm type flexible sealing plates 31 and 32 are respectively clamped by the end heads 21 and 22 through the O-rings 33** and are opposed to each other to form a hermetic pump cavity.

The sealing plates 31 and 32 are respectively provided with through holes **31*a* and 32*a* corresponding with each bypass passage 10*a* of the stator housing 10 and the sealing plate 32 is further provided with a bearing boss 32*b* to support a drive shaft 17 thereon. On the inner end wall surfaces of the end heads 21 and 22, circular recesses 21*a* and 22*a* are provided to form a pair of pressure chambers 25 and 26 which are closed by the sealing plates 31 and 32 and connected to the outlet port 12 of the stator housing 10 by way of passages 21*b* and 22*b*, the holes 31*a* and 32*a*, and the bypass passages 10*a*. The circular recesses 21*a* and 22*a* are concentric to the axis of the inner peripheral wall of the stator housing 10 and each opening area of the recesses 25 and 26 is substantially the same as those of the stator housing 10**.

Within the pump cavity enclosed between the inner peripheral wall of the stator housing 10 and the sealing plates 31 and 32, a rotor 40 is fixedly mounted through a key 16 on the drive shaft 17 which is journalled on the end head 22 through a ball bearings 18 and the bearing boss **32*b* of the sealing plate 32 and positioned eccentrically to the axis of the inner peripheral wall of the stator housing 10. The bearing boss 32*b* of the sealing plate 32 is radially inwardly clamped by a ring-shaped spring 15 to air-tightly support the drive shaft 17 so as to prevent the seepage of oil or grease from the ball bearings 18 into the pump cavity. Thus, the rotor 40 is eccentrically rotated within the pump cavity such that it makes contact with a portion of the inner peripheral wall of the stator housing 10. The rotor 40 is formed with radial slots 41 extending there-across and opening in the ends of the rotor 40. Sliding vanes 42 are mounted in the slots 41 of the rotor 40 extending there-across and terminating in planes flush with the ends of the rotor 40. Thus, during rotation of the rotor 40, the vanes 42 are moved radially outwardly from the rotor 40 responsive to centrifugal force and guided by the inner peripheral wall of the stator housing 10** to form suction and compression or delivery chambers.

In use of the dry air rotary pump having the above-mentioned construction, if the pump is driven as an air compressor, the compressed air discharged from the high pressure port 12 is supplied into the two pressure chambers 25 and 26 through the bypass passages 10*a* and the passages 21*b* and 22*b* so that the flexible sealing plates 31 and 32 are pressed to the opposite end faces of the rotor 40 due to pressure difference between the pressure chambers 25 and 26 and the pump cavity. If the pump is driven as a vacuum pump, the atmospheric pressure appearing at the outlet port 12 is applied to the two pressure chambers 25 and 26 through the bypass passages 10*a* and the passages 21*b* and 22*b* so that the flexible sealing plates 31 and 32 are pressed to the opposite end faces of the rotor 40 due to the difference between negative pressure generating within the pump cavity and the atmospheric pressure within the pressure chambers 25 and 26. Thus, the suction and compression or delivery chambers within the pump cavity are airtightly isolated one from another by means of end-face sealing contacts of the sealing plates 31 and 32 with the opposite end faces of the rotor 40 to ensure the volumetric efficiency of the pump, and oil or grease seeping into the pump cavity from the ball bearings 18 is prevented by the bearing boss 32*b* of the sealing plate 32.

In this embodiment, each of the sealing plates 31 and 32 is made of a composite consisting essentially, by weight, of 10.0 - 75.0% carbon and/or graphite, 0.1 - 60.0% molybdenum disulfide, 1.0 - 20.0% fluorine resin and the remainder, which is greater than 25.0% of the total composition by weight, being heat resistant synthetic resin without fluorine resin to have a coefficient of elasticity greater than 200 Kg/cm$^2$.

The percentages of the composite are respectively selected for the following reasons:

1. If the percentage of carbon and/or graphite is less than 10.0% by weight, the sealing plate causes scuffing when the rotary pump is driven as a vacuum pump to obtain vacuum degree of − 600 mmHg to − 650 mmHg. Conversely, the presence of carbon and/or graphite in amounts greater than 75.0% by weight acts to make the sealing plate brittle. Thus, it is preferred to use 40.0 - 50.0% carbon and/or graphite by weight.
2. Molybdenum disulfide is used to lower the coefficient of friction of the sealing plate. However, if the percentage of molybdenum disulfide is less than 0.1% by weight, the coefficient of friction of the sealing plate may not be lowered. Conversely, the presence of molybdenum disulfide in amounts greater than 60.0% by weight acts to excessively reduce the hardness of the sealing plate and to lose the elasticity of the sealing plate. Thus, it is preferred to use 3.0 - 10.0% molybdenum disulfide by weight.
3. Fluorine resin, for instance tetrafluoroethylene, is also used to lower the coefficient of friction of the sealing plate. However, if the percentage of fluorine resin is less than 1.0% by weight, the coefficient of friction of the sealing plate may not be lowered. Conversely, the presence of fluorine resin in amounts greater than 20.0% by weight acts to excessively reduce the hardness of the sealing plate. It is, therefore, preferred to use about 10.0% fluorine resin.
4. The heat resistant synthetic resin used as the remainder should preferably be selected from polyimide resin, silicone resin or the like to improve heat resistant properties of the sealing plate. Likewise, if the percentage of the remainder is less than 25.0% of the total composition, the fabrication of the sealing plate becomes very difficult. Thus, it is preferable that the percentage of the remainder is about 40.0% of the total composition by weight.

Furthermore, the inventors have found that if the coefficient of elasticity of the sealing plate is less than 200 Kg/cm$^2$, high vacuum degree cannot be obtained when the rotary pump is driven as a vacuum pump. To obtain high vacuum degree, it is preferable that the coefficient of elasticity of the sealing plate is greater than 350 Kg/cm$^2$.

To improve the flexibility of the sealing plate, the thickness of the sealing plate is designed to satisfy the following equation:

$$\frac{\text{Thickness of the sealing plate}}{\text{Inner diameter of the stator}} = 0.001 \text{ to } 0.07$$

In case the thickness of the sealing plate is thinner than the above-mentioned thickness, the sealing plate will partially be deformed outward at a portion exposed to the compression chamber of the pump so that the end-face sealing contact to the end face of the rotor may not be maintained. Conversely, if the thickness of the sealing plate is thicker than the above-mentioned thickness, the sealing plate does not absorb thermal expansion or axial displacements of the rotor when the rotor is thermally expanded in the axial direction due to heat of friction or displaces in the axial direction due to assembling errors. According to much experimentation conducted by the inventors, very satisfactory results are obtained when the above-mentioned ratio is given as 0.03 to 0.035.

Although a certain specific embodiment of the present invention has been shown and described, it is obvious that many modifications and variations thereof are possible in light of these teachings. It is to be understood therefore that within the scope of the appended claims, the invention may be practiced otherwise than as specifically described herein.

What is claimed is:

1. A dry air rotary pump or compressor comprising:

a stator housing having a cylindrical inner wall;

a pair of end heads mounted on the opposite ends of said stator housing to form a cylindrical pump cavity;

a drive shaft eccentrically journalled on one of said end heads, and extending in the interior of the pump cavity;

a rotor mounted on said drive shaft within said pump cavity and co-operating with the cylindrical inner wall of said stator housing and with the inner end walls of said end heads to form suction and compression or delivery chambers;

a pair of flexible diaphragm type sealing plates clamped on the opposite ends of said stator housing by said end heads to be pressedly contacted with the opposite end faces of said rotor, each of said sealing plates being made of a composite consisting essentially, by weight, of 10.0 - 75.0% carbon and/or graphite, 0.1 - 60.0% molybdenum disulfide, 1.0 - 20.0% fluorine resin, and the remainder, which is greater than 25.0% of the total composition by weight, being heat resistant synthetic resin without fluorine resin to have a coefficient of elasticity greater than 200 Kg/cm$^2$; and a pair of recesses provided on the inner end walls of said end heads to form a pair of pressure chambers behind each of said sealing plates.

2. A dry air rotary pump or compressor as claimed in claim 1, wherein the thickness of each of said sealing plates is related to the inner diameter of the stator according to the following equation:

$$\frac{\text{Thickness of said sealing plate}}{\text{Inner diameter of said stator}} = 0.001 \text{ to } 0.07$$

3. A dry air rotary pump or compressor as claimed in claim 1, wherein each of said sealing plates in is made of 40.0 - 50.0% carbon and/or graphite, 3.0 - 10.0% molybdenum disulfide, about 10.0% fluorine resin, and the remainder, which is substantially 40.0% of the total composition by weight, being heat resistant synthetic resin without fluorine resin to have a coefficient of elasticity greater than 350 $Kg/cm^2$.

4. A dry air rotary pump or compressor as claimed in claim 3, wherein polyimide resin is used as the remainder.

5. A dry air rotary pump or compressor as claimed in claim 3, wherein silicone resin is used as the remainder.

6. A dry air rotary pump or compressor as claimed in claim 3, wherein the thickness of each of said sealing plates is related to the inner diameter of the stator according to the following equation:

$$\frac{\text{Thickness of said sealing plate}}{\text{Inner diameter of said stator}} = 0.03 \text{ to } 0.035$$

* * * * *